United States Patent [19]

Goseberg et al.

[11] 4,388,568

[45] Jun. 14, 1983

[54] LINE END STAGE INCLUDING TRANSFORMER FOR A TELEVISION RECEIVER

[75] Inventors: Walter Goseberg; Alfred Pollak; Wolfgang Reichow, all of Hanover, Fed. Rep. of Germany

[73] Assignee: Licentia Patent-Verwaltungs-GmbH, Frankfurt am Main, Fed. Rep. of Germany

[21] Appl. No.: 202,730

[22] Filed: Oct. 31, 1980

[30] Foreign Application Priority Data

Nov. 2, 1979 [DE] Fed. Rep. of Germany ..... 2944220

[51] Int. Cl.[3] ..... H01J 29/80; H01F 27/30; H01F 27/24; H01F 27/32

[52] U.S. Cl. ..... 315/411; 335/213; 336/136; 336/198; 336/208

[58] Field of Search ..... 335/213, 282; 315/411; 336/198, 208, 136

[56] References Cited

U.S. PATENT DOCUMENTS

| | | | |
|---|---|---|---|
| 3,017,589 | 1/1962 | Chass | 336/136 |
| 3,054,976 | 9/1962 | Lipshutz | 336/136 |
| 3,138,772 | 6/1964 | Persons, Jr. | 336/136 |
| 3,573,694 | 4/1971 | von Fange et al. | 336/198 |
| 3,813,574 | 5/1974 | Sato | 315/411 X |
| 3,843,903 | 10/1974 | Miyoshi et al. . | |
| 4,153,889 | 5/1979 | Ikegami | 335/213 |
| 4,181,908 | 1/1980 | Yoshikawa | 335/213 X |
| 4,215,296 | 7/1980 | Mitamura et al. | 315/411 X |
| 4,229,786 | 10/1980 | Mitani et al. | 315/411 X |
| 4,247,889 | 1/1981 | Riechmann | 315/411 X |

FOREIGN PATENT DOCUMENTS

| | | | |
|---|---|---|---|
| 2331597 | 1/1974 | Fed. Rep. of Germany . | |
| 278842 | 10/1927 | United Kingdom | 336/208 |

OTHER PUBLICATIONS

"Der PPHV-Transformator", by Walter Goseberg, Funkshau 1/1981, pp. 70–71.

"Kaum zu fassen: 23.000 Volt zum Anfassen!-PP-HV-Zeilentrafo der Zukunft. Aus Hannover.-"-Telefunken Heute, Aktuelle Information für den Fachhandel.

*Primary Examiner*—Malcolm F. Hubler

*Attorney, Agent, or Firm*—Spencer & Kaye

[57] ABSTRACT

A line end stage for a television receiver which comprises a transformer, a first high voltage rectifier and a second high voltage rectifier. The transformer has a primary winding coupled to the line sweep coils of the receiver, and a secondary winding. The secondary winding has one end coupled through the first high voltage rectifier to ground and through the second high voltage rectifier to the anode of the television receiver picture tube. The transformer comprises a core having a longitudinal axis. The primary winding is mounted on the core coaxial with the longitudinal axis and an insulating winding form surrounds the primary winding. The winding form is provided with spaced longitudinally-distributed radially-extending chambers and the secondary winding is located within these chambers. The thicknesses of the winding form between the bottoms of the chambers and the primary winding are greatest at the ends of the winding form and become progressively smaller toward the center of the form.

10 Claims, 5 Drawing Figures

Fig. 1
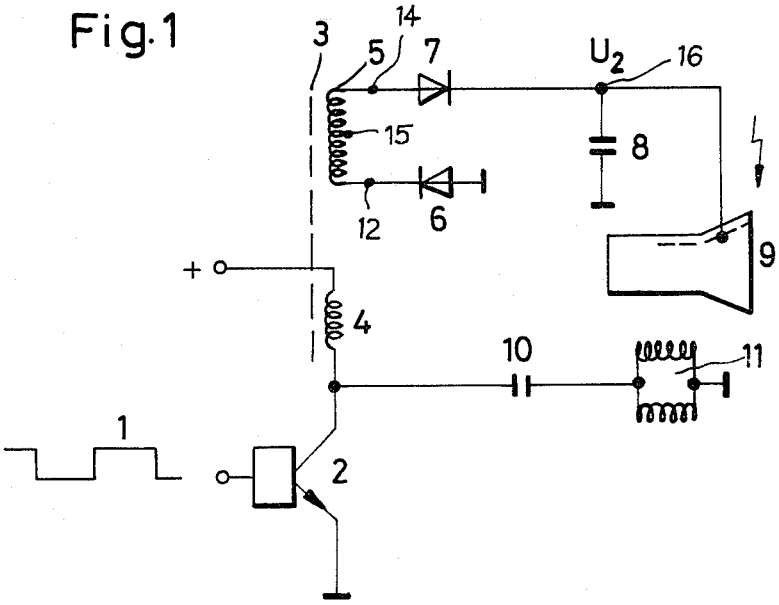
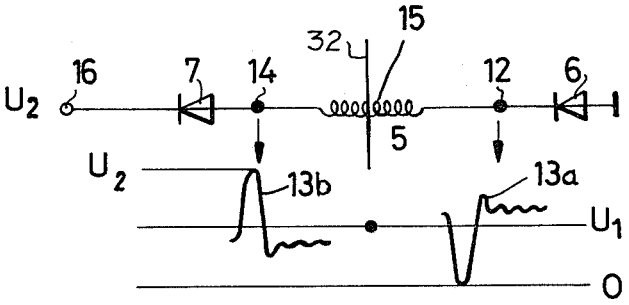
Fig. 2

LINE END STAGE INCLUDING TRANSFORMER FOR A TELEVISION RECEIVER

BACKGROUND OF THE INVENTION

This invention relates to a line end stage for a television receiver and, in particular, to a transformer comprising a component of this stage. A line end stage for a television receiver includes, among other components, a transistor which functions as a switch, a high voltage rectifier, and a transformer having a primary winding and a high voltage secondary winding. The line end stage produces the high voltage required to energize the picture tube.

A conventional line end stage of this type is a relatively expensive and heavy part of the receiver, whih must withstand high voltages and currents on the order of 25,000 volts and two to three amperes. It performs several functions such as controlling the line sweep coils, and generating the high voltage for the picture tube, pulses for gating purposes and the direct operating voltages. Consequently, the stage must satisfy a number of different requirements.

More specifically, the line end stage should be as small as possible, light in weight and easy to manufacture. A low internal impedance is desirable and, despite the relatively high power involved, the stage should operate over long periods without malfunctioning.

It is known that a low internal impedance can be attained by tuning the stray inductance of the high voltage winding and the effective capacitance to certain oddnumbered harmonics of the frequency of the retrace or return sweep oscillation of the line transformer. In this way, the pulse shape of the retrace pulse is broadened so as to reduce the internal impedance of the high voltage source, it being of particular advantage to tune to the ninth harmonic of the return sweep oscillation frequency. However, tuning to such a high frequency presents a number of technical problems because of the design of the line end stage, and because the effective inductances and capacitances must not exceed certain values. Maintaining these values and simultaneously meeting the other requirements is often difficult in practice.

It is an object of the present invention to provide a line end stage having a particularly simple design and which provides a fixed coupling between the primary and high voltage windings, the stray inductance of the high voltage winding being particularly low. This stage permits tuning to the desired harmonic of the frequency of the return sweep oscillation.

SUMMARY OF THE INVENTION

In accordance with the present invention, a line end stage for a television receiver is provided which comprises a transformer, a first high voltage rectifier and a second high voltage rectifier. The transformer has a primary winding coupled to the line sweep coils of the receiver, and a secondary winding. The secondary winding has a first end coupled through the first high voltage rectifier to ground and a second end coupled through the second high voltage rectifier to the anode of the television receiver picture tube.

The transformer comprises a core having a longitudinal axis. The primary winding is mounted on the core coaxial with the longitudinal axis, and an insulating winding form surrounds the primary winding. The winding form is provided with spaced, longitudinally-distributed, radially—extending chambers, the secondary winding being located within these chambers. The thickness of the winding form between the bottoms of the chambers and the primary winding is greatest at the ends of the winding form and become progressively smaller toward the center of the form.

The present invention offers a plurality of advantages with respect to the design, insulation and voltage distribution of the line transformer. In order to obtain a desired high voltage for the picture tube, a pulse voltage of a particular amplitude must be present across the high voltage winding, and with a given primary this determines the number of turns in the winding. In the present invention, the amplitude of the pulse voltage across the high voltage winding is the same as in prior art circuits in which the high voltage winding is directly grounded at one end. However, several advantages are obtained which are not realized with conventional circuits.

Since the first end of the high voltage winding is grounded through the first high voltage rectifier, it is maintained at a voltage having a direct component and an alternating component. An alternating voltage component is also present at the second end of the high voltage winding, this component having the same amplitude and being of opposite polarity from the alternating voltage component present at the first end of the winding. Accordingly, the alternating voltage component is zero at the center of the high voltage winding thereby producing an alternating voltage symmetry in the high voltage winding relative to the primary winding.

In prior art circuits having one end of the high voltage winding directly grounded, the alternating voltage has the required amplitude only at the ungrounded end of the winding. In contrast, in the present invention, the alternating voltages present at both ends of the coil are in phase opposition and at half the amplitude with respect to ground as compared to the alternating voltage at the ungrounded end of the conventional high voltage winding. The amplitude of the maximum alternating voltage is thus divided approximately in half compared to the maximum alternating voltage in the prior art circuit. This symmetry and reduction of voltage compared to the prior art circuit has several advantages.

The maximum amplitude of the alternating voltage is less than in the prior art circuit and therefore the thickness of the insulation between the high voltage winding and the primary winding can be reduced. This results in tighter coupling between the two windings, reduction in the stray inductance and simplifies tuning to the ninth harmonic.

The reduced amplitude of the alternating voltage across the high voltage winding is also beneficial because the capacitive currents flowing between the high voltage and primary windings are reduced in amplitude. In the prior art circuit, these capacitive currents are practically zero at the grounded end of the high voltage winding but increase toward the ungrounded end to a value corresponding to the amplitude of the alternating voltage at that end. In contrast, in the circuit according to the present invention, the amplitude of the capacitive current is zero at the center of the high voltage winding because the amplitude of the alternating voltage at this point is zero. The capacitive currents increase towards the ends of the high voltage winding to approximately equal and opposite values; however, these values are about half the maximum value of the capacitive current in the prior art circuit. Also, the integrated sum of the capacitive reactive currents flowing across the distributed winding capacitances is lower in the circuit according to the present invention than in the prior art circuit.

The fact that the amplitude of the alternating voltage at the center of the high voltage winding is zero can be utilized to advantage in the design of the winding form for the high voltage winding by making the insulating space at the center smaller than at the ends of the high voltage winding. According to one embodiment of the invention, the insulating space between the two windings is determined by the amplitude distribution of the effective alternating voltage across the high voltage winding.

In the present invention, the high voltage winding has about the same alternating voltage load at both ends, and the alternating voltages appearing at these two ends have the same shape and amplitude but are of opposite polarity. Accordingly, the interfering radiation emanating from the line transformer is reduced because the voltages at the ends of the high voltage winding partially cancel each other.

The primary and secondary sides of the transformer each contain only a single winding and are not provided with taps, thereby greatly simplifying the design of the transformer. In particular, this simple design permits fixed coupling and attainment of a low stray inductance for the high voltage winding which enhances tuning to a high harmonic of the frequency of the return sweep oscillation.

BRIEF DESCRIPTION OF THE DRAWINGS

FIG. 1 is a schematic circuit diagram of the invention.

FIG. 2 shows voltage curves for explaining the operation of the circuit of FIG. 1.

DESCRIPTION OF THE PREFERRED EMBODIMENTS

Figure 3:
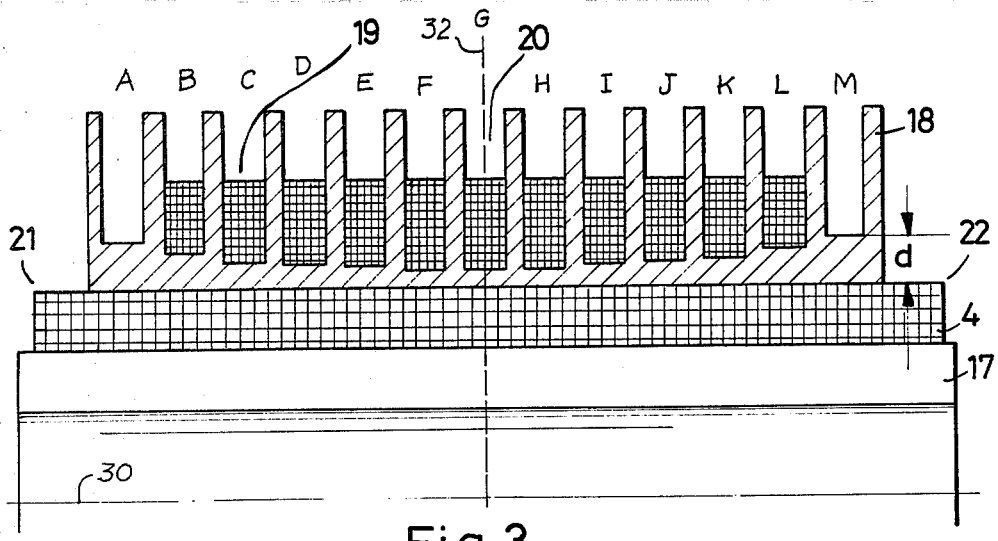
FIG. 3 is an embodiment of the coil assembly of the transformer.

FIG. 1 is a schematic diagram of the line end stage of a television receiver which includes a switching transistor 2 having its base connected to an input terminal for switching by a square-wave input signal 1, a transformer 3 having a primary winding 4 and a high voltage secondary winding 5, two high voltage rectifiers 6 and 7, a smoothing capacitor 8, a picture tube 9, a coupling capacitor 10 which also serves as a tangential equalizer and line sweep coils 11. The anode of diode 6 is grounded and its cathode is connected to one end 12 of the secondary winding 5. The anode of diode 7 is connected to the other end 14 of secondary winding 5, its cathode being grounded for alternating voltages by capacitor 8 which is formed essentially by the capacitance of the anode coating of the picture tube 9. With these connections, the two ends 12 and 14 of the secondary winding 5 carry substantially the same load.

Referring to FIG. 2, the diode 6 prevents the return sweep voltage 13*a* at point 12 from becoming negative by clamping the negative peak of that voltage at ground potential. A direct voltage $U_1$ is generated at point 12 and also at point 14. Since the winding 5 is inductive, the return sweep voltage 13*b* at point 14 is of opposite polarity with respect to the voltage 13*a* at point 12. Thus, the alternating voltage at the center 15 of the winding is equal to zero and the distribution of the alternating voltage about the line 32 is symmetrical with respect to ground.

The voltage present at point 14 is rectified by rectifier 7 so that the voltage $U_2$ at terminal 16 functions as the anode voltage for the picture tube 9. If the terminal 12 were grounded, approximately the same direct voltage $U_2$ would be produced at terminal 16 but the advantages of the present invention would not be obtained.

The amplitude of the alternating voltage component across winding 5 differs greatly from one end to the other. That is, the alternating voltage between winding 5 and ground is zero at the center of the winding and reaches maximum values of opposite polarities at the ends 12 and 14. This permits the insulation space between the high voltage winding 5 and primary winding 4 of transformer 3 to be a function of its position along the winding.

Referring to FIG. 3, the structure of transformer 3 is shown in which the primary winding 4 surrounds a core 17 having a longitudinal axis 30. An insulating winding form 18 having a plurality of chambers 20 surrounds winding 4. The high voltage winding 5 comprises partial windings 19 disposed in those chambers 20 designated by the letters B through L, chambers A and M not having windings placed therein.

All of the partial windings 19 lying within the chambers 20 are wound one after another without any interruption of the wire. The wire is fed through slots within the walls forming the chambers 20. That means that all of the partial windings 19 are series-connected without any interruption, and form together the winding 5 of FIG. 1.

The thickness d of the winding form 18 at the bottom of each of the respective chambers 20 is a minimum at the center of the form along radial axis 32 where the amplitude of the alternating voltage is substantially equal to zero, the thickness increasing symmetrically along a parabolic curve toward the two ends of the winding form 18. In an actual embodiment tested, the wall thickness d of chambers A–M had the following values:

| Chamber | d in mm |
|---|---|
| A | 2.0 (empty) |
| B | 1.6 |
| C | 1.3 |
| D | 1.2 |
| E | 1.1 |
| F | 1.0 |
| G | 1.0 |
| H | 1.0 |
| I | 1.1 |
| J | 1.2 |
| K | 1.3 |
| L | 1.6 |
| M | 2.0 (empty) |

The wall thickness d, which determines the insulating space between the high voltage winding 5 and the primary winding 4, corresponds to the amplitude of the alternating voltage distribution along the longitudinal axis of the winding form.

Chambers A and M are intentionally not provided with a winding 19. This has the advantage that the space between the first winding in chamber B and the sharp edge of end 21 of primary winding 4 is relatively large, thereby reducing the danger of arcing at the edge of the winding. Similarly, the distance between the winding in chamber L and the edge of end 22 of the primary winding 4 is relatively large to reduce the possibility that arcing will occur at this end of the transformer.

As shown in FIG. 3, the number of turns of the windings 19 in the individual chambers 20 are, in general, not the same. That is, the radial thicknesses of the windings in chambers F, G and H are equal but the thickness of the windings in the chambers on either side of chambers F and H decrease significantly and are at a minimum in chambers B and L, the stray inductance being controlled to permit tuning to a desired harmonic.

If, for example, the winding is distributed so that there are more turns at the center of the winding form 18 where the distance between the high voltage winding 5 and the primary winding 4 is smaller than at the edges, the coupling is closer at the center thereby changing the stray inductance compared to that which would have been obtained with a uniform winding distribution.

It is desirable that the stray inductance of the winding 5 together with all effective capacitances be tuned to a frequency corresponding to the ninth harmonic of the frequency of the line fly back pulse in order to achieve a low value of internal resistance at terminal 16 of the high voltage source. The stray inductance of the winding 5 which is necessary for achieving this resonant frequency can be obtained by a proper distribution of the partial windings 19 within the chambers 20. In particular the stray inductance can be kept low because the distance between the partial windings 19 in the middle region of form 18, i.e. around chamber G can be made very small. This is possible as the value of the ac-voltage in this region corresponding to center 15 in FIG. 2 is zero.

Figure 4:
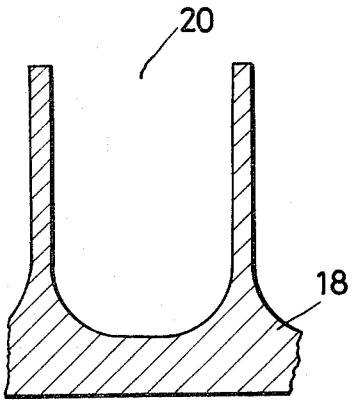
FIGS. 4 and 5 illustrate additional embodiments of the chambers of the winding form depicted in FIG. 3.

FIG. 4 shows an embodiment of the winding form in which the edges along the bottom of the chamber 20 are rounded so as to have a fluted shape in order to reduce arcing, rounding the circumferential edges reducing the probability that arcing will take place. Moreover, the wire comprising the turns of the high voltage winding can more conveniently be placed in the chambers 20 during winding.

Figure 5:
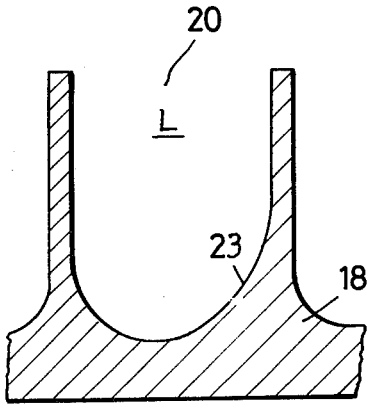

In FIG. 5, the radii or curvature at the two edges of the chambers 20 are different. This configuration is employed for the first and last chambers B and L having a winding 19 placed therein, the edge 23 having the larger radius of curvature being located at the end of the winding form. Thus, a chamber shaped as shown in FIG. 5 would be used for chamber L to reduce the chance of arcing between edge 22 and the coil placed in chamber L. The embodiment of FIG. 5 is preferably provided only for chambers B and L.

It will be understood that the above description of the present invention is susceptible to various modifications, changes and adaptations, and the same are intended to be comprehended within the meaning and range of equivalents of the appended claims.

What is claimed is:

1. In a televison receiver having line sweep coils and a picture tube, a line end stage comprising a transformer coupled to said line sweep coils including a core having a longitudinal axis;

a single continuous untapped primary winding mounted on said core, said primary winding being coaxial with said longitudinal axis;

an insulating winding form surrounding said single primary winding, said winding form being coaxial with said longitudinal axis and being provided with spaced longitudinally-distributed radially-extending chambers; and a single continuous untapped secondary winding located within the chambers of said winding form, the distances between the bottoms of the chambers within said winding form and said primary winding decreasing from the ends of said winding form toward the center thereof along said longitudinal axis;

a first high voltage rectifier having its anode connected to ground and its cathode connected to one end of said secondary winding; and a second high voltage rectifier having its anode connected to the other end of said secondary winding and its cathode connected to the anode of said picture tube.

2. A line end stage as defined in claim 1 wherein the thickness of the insulation of said insulating winding form between said primary and secondary windings is a minimum along a line perpendicular to said longitudinal axis at the center of said core and increases toward the end of said core.

3. A line end stage as defined in claim 1 wherein the thickness of said winding form between the bottom of the chamber at the center of said winding form and said primary winding has a predetermined value, and the thicknesses of each of said chambers toward the ends of said winding form and said primary winding increases with respect to that at the center as a function of the distance from said center chamber.

4. A line end stage as defined in claim 1 wherein at least one of said chambers has parallel sides and the bottom thereof is perpendicular to said sides.

5. A line end stage as defined in claim 1 wherein the chambers at the ends of said winding form are empty, and said secondary winding is located within the chambers therebetween.

6. A line end stage as defined in claim 1 wherein the thicknesses of the secondary windings within said chambers are different, said thicknesses being selected to tune said secondary winding to a predetermined harmonic of the frequency of the return sweep oscillation of said television receiver.

7. A line end stage as defined in claim 1 wherein said primary winding extends in the direction of said longitudinal axis beyond said secondary winding.

8. A line end stage as defined in claim 1 wherein at least one of said chambers has parallel sides and the bottom thereof has a rounded fluted shape.

9. A line end stage as defined in claim 8 wherein the edge of said bottom adjacent one side of said chamber has a different radius of curvature than the edge adjacent the other side of said chamber.

10. A line end stage as defined in claim 9 wherein the chambers containing said secondary winding at the ends of the said winding form have said rounded fluted shape and wherein the edges of the bottoms of said chambers facing the ends of said winding form have a larger radius of curvature than the opposite edges of said chambers.

* * * * *